US005565728A

United States Patent [19]

Jung

[11] Patent Number: 5,565,728

[45] Date of Patent: Oct. 15, 1996

[54] NEON LAMP WITH FLEXIBLE CONNECTORS

[76] Inventor: Huang H. Jung, P.O. Box 82-144, Taipei, Taiwan

[21] Appl. No.: 516,065

[22] Filed: Aug. 17, 1995

Related U.S. Application Data

[63] Continuation-in-part of Ser. No. 173,892, Dec. 27, 1993, Pat. No. 5,489,813.

[51] Int. Cl.[6] ..... H01J 5/50

[52] U.S. Cl. ..... 313/51; 313/318.02; 313/318.03; 362/226

[58] Field of Search ..... 313/51, 643, 637, 313/312, 318.02, 318.03, 25; 439/611, 612, 617, 618; 315/185 R, 189, 185 S; 362/226

[56] References Cited

U.S. PATENT DOCUMENTS 1,839,479 8/1928 Hartman .
2,095,291 12/1934 Schneider .
4,092,562 5/1978 Campbell ..... 313/318.02
5,018,980 5/1991 Robb ..... 313/318.02
5,154,508 10/1992 Ahroni ..... 362/226
5,489,813 2/1996 Jung ..... 313/51

*Primary Examiner*—Michael Horabik
*Assistant Examiner*—Michael Day
*Attorney, Agent, or Firm*—Alfred Lei

[57] ABSTRACT

A neon lamp including a transparent outer tube, a neon bulb fitted in the transparent outer tube, a first sleeve fitted over one end of the transparent outer tube, a second sleeve fitted over another end of the transparent outer tube, a male electrical connector connected at one end with the first sleeve via a first flexible cable, and a female electrical connector connected at one end with the second sleeve via a second flexible cable.

1 Claim, 4 Drawing Sheets

NEON LAMP WITH FLEXIBLE CONNECTORS

CROSS-REFERENCE

This is a continuation-in-part of the former U.S. patent application Ser. No. 08/173,892, filed Dec. 27, 1993, now U.S. Pat. No. 5,489,815, which was allowed on Jun. 13, 1995.

BACKGROUND OF THE INVENTION

1. Field of the Invention

This invention relates to an improved neon lamp.

2. Description of the Prior Art

The neon lamp has been largely used in commercial signs. However, the conventional neon lamps are made into desired shapes in advance and tied or adhered together in order to form a predetermined pattern thereby making it time-consuming and inconvenient to assemble the neon lamps. In addition, the neon lamps will become useless and have to be disposed of after use.

Therefore, it is an object of the present invention to provide an improved neon lamp which can obviate and mitigate the above-mentioned drawbacks.

SUMMARY OF THE INVENTION

This invention relates to an improved neon lamp.

It is the primary object of the present invention to provide a neon lamp which can be easily connected with a plurality of similar neon lamps in series.

It is another object of the present invention to provide a neon lamp which can be connected with another one at an angular position.

It is still another object of the present invention to provide a control device which can make a plurality of neon lamps turn on or turn off in predetermined sequence.

It is still another object of the present invention to provide a neon lamp which is simple in construction.

It is a further object of the present invention to provide a neon lamp which is practical in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1A:
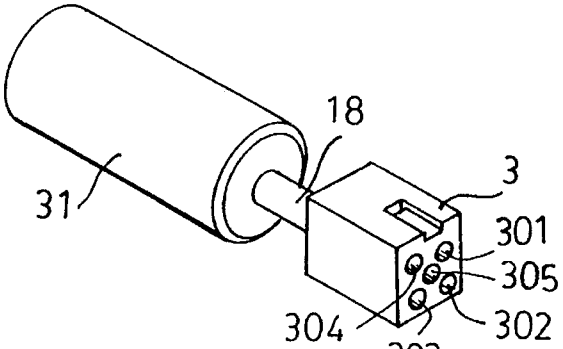
FIG. 1A is a perspective view of the female connector.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 1:
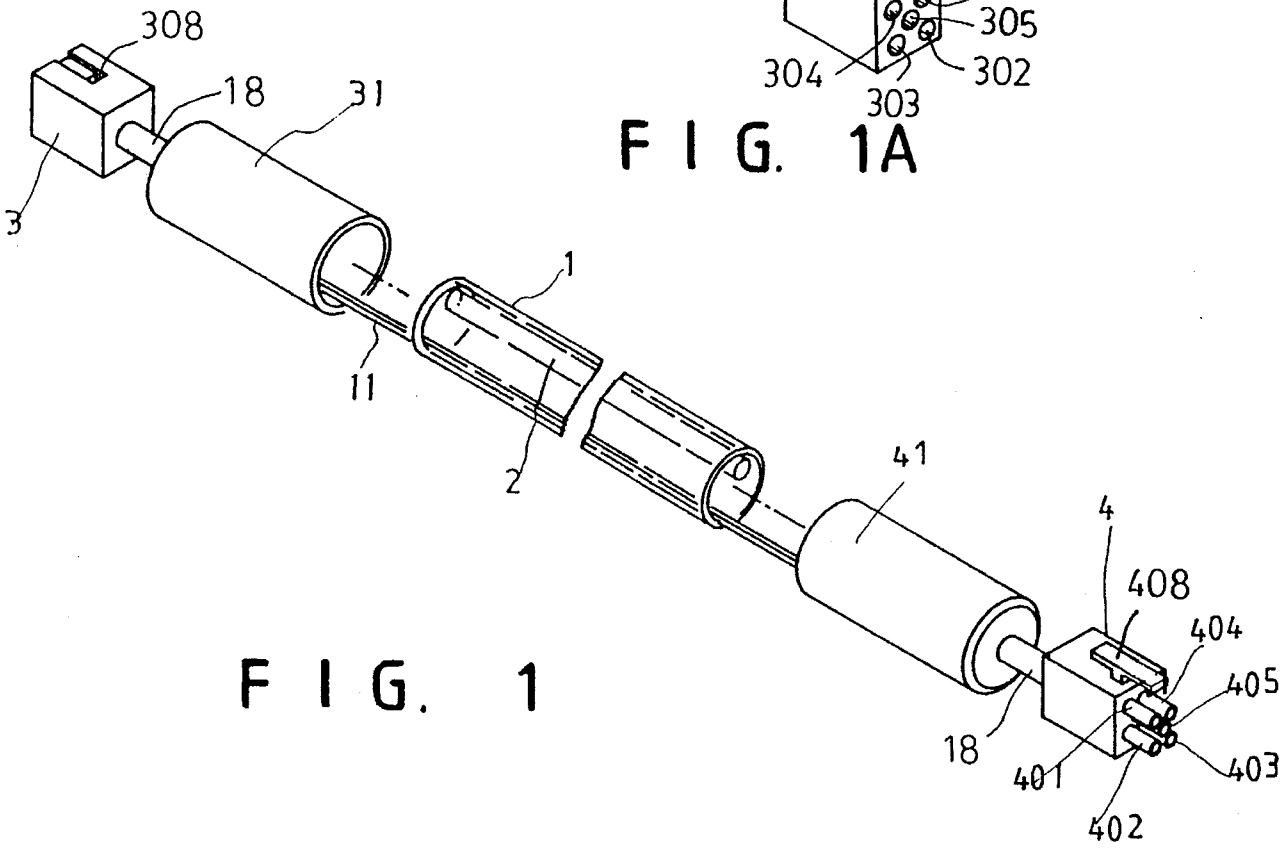
FIG. 1 is a perspective view of the present invention.
Figure 2:
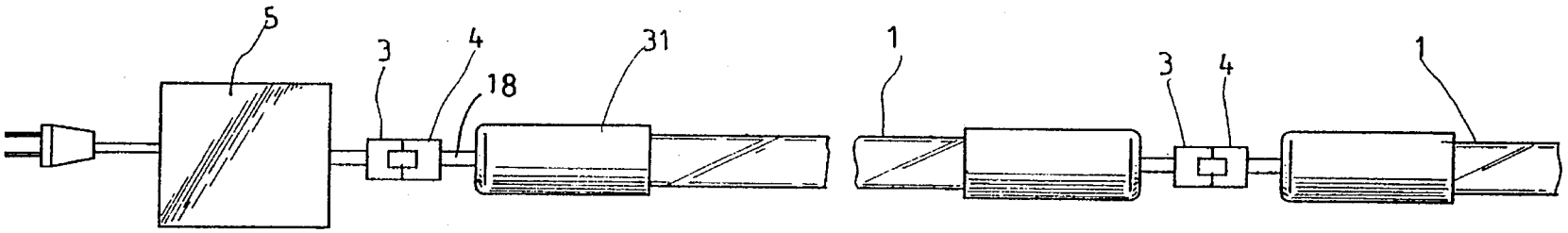
FIG. 2 is a working view of the present invention.

With reference to the drawings and in particular to FIGS. 1 and 2 thereof, the neon lamp according to the present invention mainly comprises a transparent outer tube 1, a neon bulb 2, two sleeves 31 and 41, a female electrical connector 3 and a male electrical connector 4.

The neon bulb 2 is fitted within the transparent outer tube 1 and is connected with the electrical female connector 3. The connection between the neon bulb 2 and the female electrical connector 3 may be of any conventional design well known to those skilled in the art and is not considered a part of the invention.

The sleeves 31 and 41 are fitted over the left and right ends of the tubular member 1, respectively.

The male electrical connector 4 is connected with the sleeve 41 via a flexible cable 18. The male electrical connector 4 is provided with five pins 401, 402, 403, 404 and 405 at an end and a hook portion 408 at the top. The pin 405 is located at the center while the other pins 401, 402, 403 and 404 surrounds the pin 405.

As shown in FIGS. 1, 1A and 2, the female connector 3 is provided with five cavities 301, 302, 303, 304 and 305 at an end adapted to receive the pins 401, 402, 403, 404 and 405 of a male electrical connector 3 of another similar neon lamp, and a recess 308 at the top adapted to engage with the hook 408 of the male connector 3, so that a plurality of neon lamps according to the present invention can be conveniently connected in series. Further, the female connector 3 is electrically connected with the male connector 4 by wires 11. The male connector 4 of the neon lamp is connected with a female connector 3 which is in turn connected with a control circuit 5.

Figure 3:
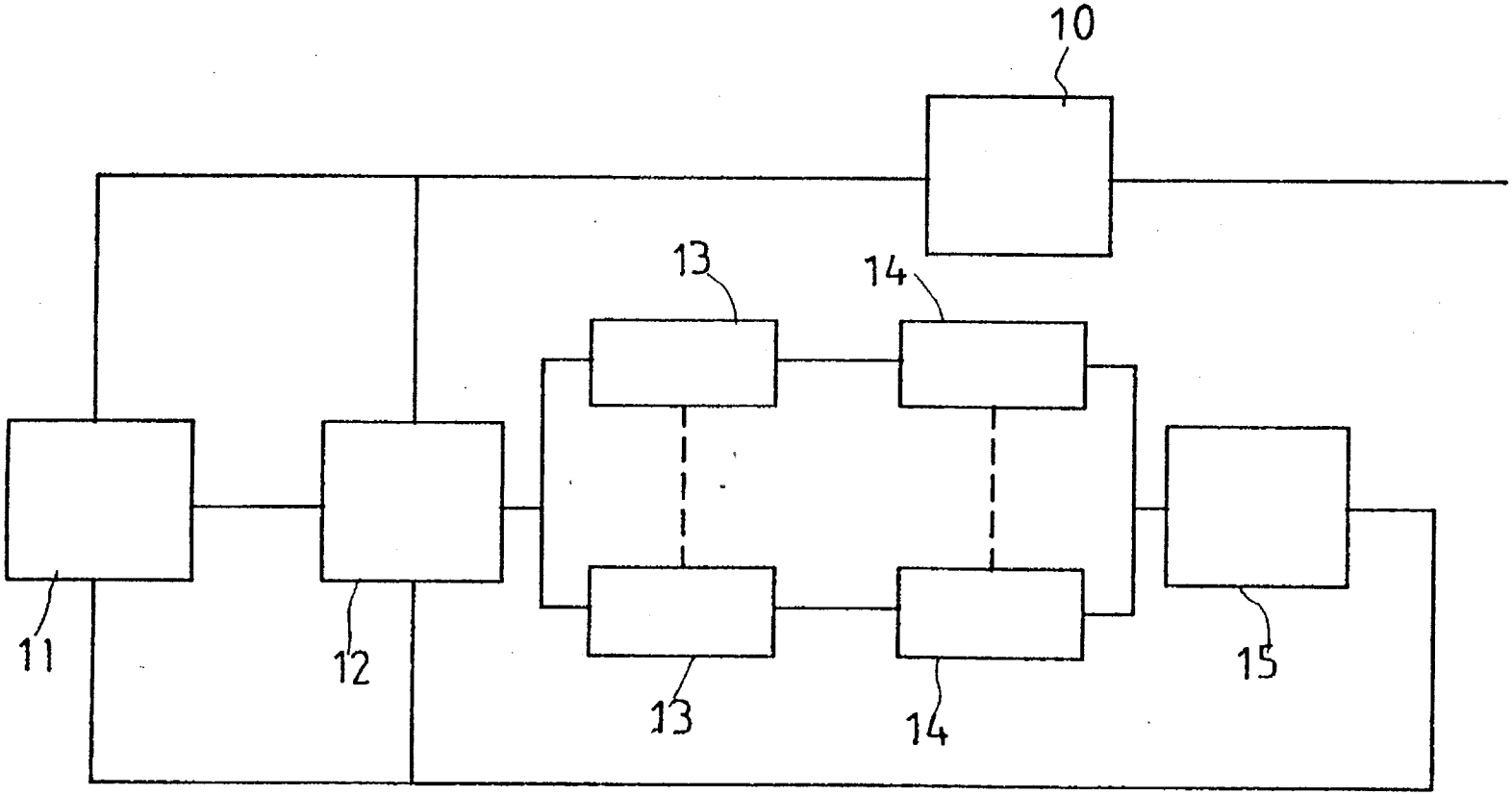
FIG. 3 is a block diagram of the present invention.
Figure 4:
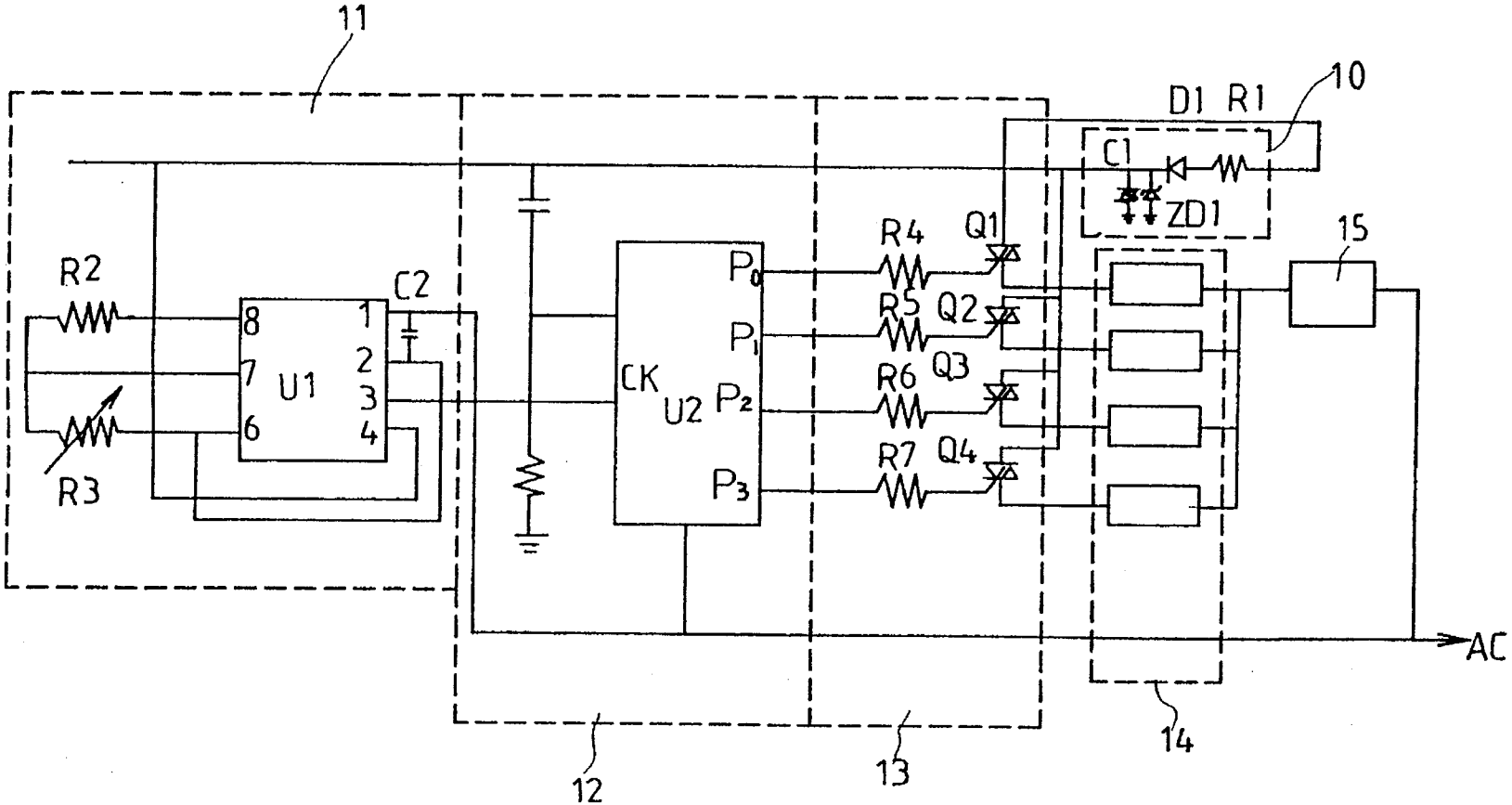
FIG. 4 is a circuit diagram of the present invention.

Referring to FIGS. 3 and 4, the control circuit 5 includes a voltage regulating circuit 10, a timing circuit 11, counter 12, a switching circuit 13, and a step-up circuit 15. The voltage regulating circuit 10 includes a resistor R1, a diode D1, a zener diode ZD1, and a capacitor C1. The time constant of the timer U1 is determined by R2, R3 and C2. The variable resistor R3 can be adjusted to cause the timer U1 to output a pulse signal to trigger the counter U2 to output at terminals P1–P4 in predetermined sequence. Then the bidirectional diodes Q1–Q4 are driven by the resistors R4–R7. In association with the step-up circuit 15, the neon-lamps 14 are actuated to turn on and off in determined sequence.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A neon lamp comprising:

a transparent outer tube;

a neon bulb fitted in said transparent outer tube;

a first sleeve fitted over one end of said transparent outer tube;

a second sleeve fitted over another end of said transparent outer tube;

a male electrical connector connected at one end with said first sleeve via a first flexible cable, said male electrical connector being provided with a plurality of pins at another end and a hook portion at a top, said pins being arranged in such way that one of said pins is located at a center of said male electrical connector while others of said pins surround said one pin; and a female electrical connector connected at one end with said second sleeve via a second flexible cable, said female electrical connector being provided with a plurality of cavities at an outer end adapted to receive the pins of said male electrical connector and a recess at a top adapted to engage with the hook portion of said male connector, said cavities being arranged in a way such that one of said cavities is located at a center of said female electrical connector while others of said cavities surround said one cavity.

* * * * *